US005857436A

United States Patent [19]

Chen

[11] Patent Number: 5,857,436

[45] Date of Patent: Jan. 12, 1999

[54] INTERNAL COMBUSTION ENGINE AND METHOD FOR GENERATING POWER

[75] Inventor: Tze-Ning Chen, Sudbury, Mass.

[73] Assignee: Thermo Power Corporation, Waltham, Mass.

[21] Appl. No.: 925,602

[22] Filed: Sep. 8, 1997

[51] Int. Cl.[6] ..... F02B 33/22

[52] U.S. Cl. ..... 123/70 R; 123/68; 60/517

[58] Field of Search ..... 60/517; 123/70 R, 123/68, 71 R

[56] References Cited

U.S. PATENT DOCUMENTS

| | | | |
|---|---|---|---|
| 1,372,216 | 3/1921 | Casaday | 123/68 |
| 1,512,673 | 10/1924 | Breguet | 123/68 |
| 1,746,728 | 2/1930 | Ensign | 123/68 |
| 2,349,967 | 5/1944 | Javal | 123/68 |
| 3,623,463 | 11/1971 | DeVries | 123/70 R |
| 4,040,400 | 8/1977 | Kiener | 123/68 |
| 4,270,494 | 6/1981 | Garter et al. | 123/193.6 |
| 4,344,405 | 8/1982 | Zaharis | 123/68 |
| 4,458,635 | 7/1984 | Beasley | 123/68 |
| 4,476,821 | 10/1984 | Robinson et al. | 123/68 |
| 4,633,668 | 1/1987 | Corey | 60/517 |
| 4,715,326 | 12/1987 | Thring | 123/70 R |
| 4,760,698 | 8/1988 | Bartolini et al. | 60/517 |
| 5,085,179 | 2/1992 | Faulkner | 123/70 R |
| 5,417,066 | 5/1995 | Kawano et al. | 60/517 |
| 5,499,605 | 3/1996 | Thring | 123/70 R |

FOREIGN PATENT DOCUMENTS

| | | | |
|---|---|---|---|
| 56-27031 | 3/1981 | Japan | 123/68 |

*Primary Examiner*—David A. Okonsky
*Attorney, Agent, or Firm*—Pandiscio & Pandiscio

[57] ABSTRACT

An internal combustion engine includes a compression cylinder having an air inlet and outlet, a conduit extending from the compression cylinder air outlet, an expansion cylinder of larger diameter than the diameter of said compression cylinder and having an inlet and outlet, and a heat exchanger disposed in the conduit and having a first passageway for flowing compressed air from the compression cylinder outlet to the expansion cylinder inlet, the expansion cylinder outlet being in communication with a second passageway in the heat exchanger for flowing combustion exhaust gases from the expansion cylinder through the heat exchanger. The heat exchanger operates to heat the compressed air before entry into the expansion cylinder and to cool the exhaust gases before entry into an exhaust conduit in communication with the heat exchanger second passageway.

16 Claims, 6 Drawing Sheets

INTERNAL COMBUSTION ENGINE AND METHOD FOR GENERATING POWER

BACKGROUND OF THE INVENTION

1. Field of the Invention

This invention relates to internal combustion engines and is directed more particularly to an engine exhibiting improved thermal efficiencies, and to an improved method for generating power.

2. Description of the Prior Art

It is known to improve thermal efficiency of a gas turbine engine by employing a regenerative heat exchanger which operates to extract heat from combustion exhaust gases and to use the extracted heat to raise the temperature of compressed air prior to its entering the combustion chamber.

The use of heat exchangers in internal combustion engines to obtain improved thermal efficiencies, similarly to the use and improvement in gas turbine engines, is difficult because of the cyclic nature of the engine operation and the limited space inside the internal combustion engine combustion cylinder. Providing a regenerative thermal mass to receive and store heat from the combustion exhaust gas during an exhaust stroke and applying the heat to the compressed air charge, or fuel-air mixture, at the end of the compression stroke is theoretically possible but difficult in practice because of the requirement of providing sufficient heat transfer area while limiting the heat storage mass to a size suitable for disposition in the combustion space.

It is further known that spark ignition engines typically exhibit lower efficiencies than diesel engines because of the limited compression ratios of spark ignition engines. However, spark ignition engines can be made to provide efficiencies equal to those of diesel engines by employing a "more-complete-expansion" cycle. In such a cycle, the effective compression ratio is set in the 8–12 range by timing the closing of the inlet valve, while the expansion ratio is maintained in the 16–20 range. The more-complete-expansion approach is known and is used in commercially available spark ignition engines.

It is still further known that using insulated cylinder walls to reduce heat loss from the combustion gas to the ambient. air increases the power output in the expansion process. However, using insulated materials on the cylinder walls also causes the air to be heated and the compression power to increase, which counteracts the power gain in the expansion process. Therefore, the net gain in power output of the engine is low.

There is thus a need for an internal combustion engine having therein heat transfer means for extracting heat from combustion exhaust gasses and applying that heat to compressed air, or fuel-air mixture, prior to the initiation of the combustion process.

There is further a need for such an engine wherein substantially complete expansion is experienced.

There is still further a need for such an engine having a low compression ratio and a low air temperature at the end of compression and a low peak cylinder pressure, such that fuels with low octane rating do not cause engine detonation, and heavy construction, as in diesel engines, is not required, and an engine so provided is of less weight than a conventional diesel engine.

There is still further a need for an internal combustion engine having therein insulation means to reduce heat loss from the combusted gas while not causing heating of the air charge during compression.

There is still further a need for a method for generating power, which method is more efficient than previous methods utilizing internal combustion engines.

SUMMARY OF THE INVENTION

An object of the invention is, therefore, to provide an internal combustion engine having a heat exchanger therein for extracting heat from combustion exhaust gases and applying the extracted heat to compressed air, or fuel-air mixture, before the initiation of the combustion process.

A further object of the invention is to provide such an engine wherein the expansion ratio is larger than the compression ratio and wherein substantially complete expansion occurs.

A further object of the invention is to provide such an engine having a relatively low compression ratio and relatively low peak cylinder pressure.

A still further object of the invention is to provide such an engine as is of an overall weight less than a comparable conventional diesel engine.

A still further object of the invention is to provide such an engine having minimal heat loss from the combusted gas and maximum heat rejection from the air charge during intake and compression.

A still further object of the invention is to provide an improved method for generating power.

With the above and other objects in view, as will hereinafter appear, a feature of the present invention is the provision of an internal combustion engine comprising a compression cylinder having an inlet and an outlet, a conduit extending from the compression cylinder outlet, an expansion cylinder having an inlet and an outlet, a heat exchanger disposed in the conduit and having a first passageway for flowing compressed air from the compression cylinder to the expansion cylinder, the expansion cylinder outlet being in communication with a second passageway in the heat exchanger for flowing exhaust gases from the expansion cylinder through the heat exchanger. The heat exchanger operates to heat the compressed air before entry into the expansion cylinder.

A further feature of the invention is the provision of an internal combustion engine comprising a compression cylinder having a first internal diameter, an inlet, an outlet, and a compression piston in the compression cylinder, an expansion cylinder having a second internal diameter, an inlet, an outlet, and an expansion piston in the expansion cylinder, and a conduit. extending from the compression cylinder outlet to the expansion cylinder inlet, wherein the first diameter is substantially smaller than the second diameter, to permit substantially complete expansion in the expansion cylinder.

A still further feature of the invention is the provision in the internal combustion engine summarized immediately above, of a thermally insulated expansion cylinder.

In accordance with a still further feature of the invention, there is provided a method for generating power, the method comprising the steps of compressing air, flowing the compressed air through a heat exchanger first passageway to increase the temperature of the air, flowing the compressed air from the heat, exchanger into an expansion cylinder combustion chamber, flowing fuel into the combustion chamber to provide a fuel and air mixture, combusting the fuel and air mixture in the combustion chamber, expanding the combustion gas in the expansion cylinder to a larger volume than the initial air volume to produce a power stroke, and flowing combustion exhaust gases from the expansion cylinder and through a second passageway of the heat exchanger to impart heat to further compressed air in the first passageway of the heat exchanger.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
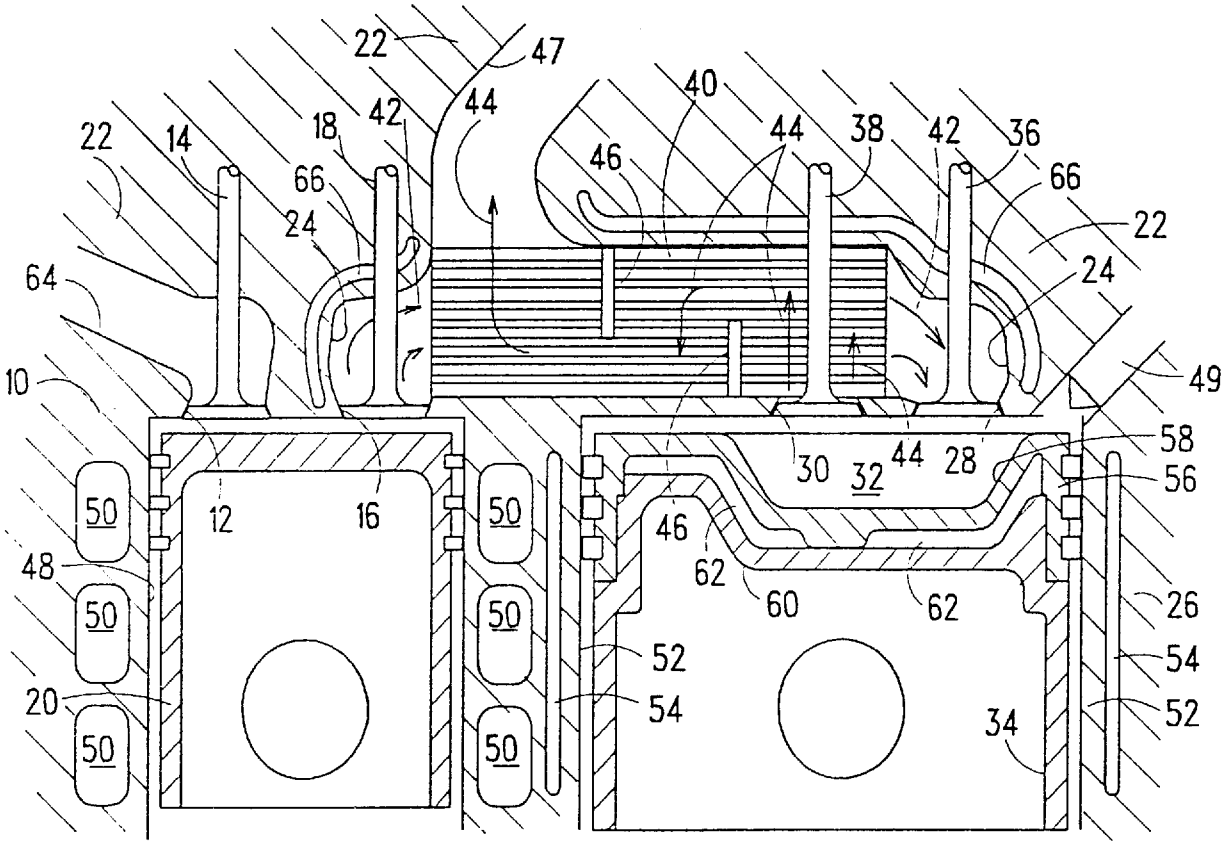
FIG. 1 is a diagrammatic sectional view of one form of internal combustion engine illustrative of an embodiment of the invention.

Referring to FIG. 1, it will be seen that an illustrative embodiment of the invention includes a compression cylinder 10 having an air inlet 12 and an air inlet valve 14, and an air transfer outlet 16 and air transfer outlet valve 18. A compression piston 20 is reciprocally movable in the compression cylinder 10. The air inlet 12 and transfer outlet 16 are disposed in a head portion 22 of the compression cylinder 10.

A transfer conduit 24 is disposed in the head portion 22 of the compression cylinder 10 and extends from the compression cylinder air transfer outlet 16 for flowing compressed air from the compression cylinder 10.

An expansion cylinder 26 is disposed adjacent the compression cylinder 10 and is provided with a compressed air inlet 28 and compressed air inlet valve 36 and a combustion gas outlet 30 and combustion gas outlet valve 38 disposed in the head portion 22 of the expansion cylinder 26, which, as shown in FIG. 1, may comprise an extension of the head portion of the compression cylinder 10. The air inlet 28 interconnects the transfer conduit 24 and a combustion chamber 32 in the expansion cylinder 26. An expansion piston 34 is reciprocally movable in the expansion cylinder 26.

The illustrative internal combustion engine further includes a heat exchanger 40 disposed in the transfer conduit 24 and providing a first passageway for flow, shown by arrows 42 in FIG. 1, from the compression cylinder air transfer outlet 16 to the combustion chamber 32 of the expansion cylinder 26. The heat exchanger 40 is further provided with a second passageway for flow, shown by arrows 44 in FIG. 1, from the expansion cylinder combustion gas outlet 30 to an exhaust conduit 47 in the head portion 22. The heat exchanger 40 may be provided with baffles 46 which in part define the second passageway which traverses the first passageway a plurality of times, depending upon the length of the heat exchanger and the number of baffles.

The internal diameter of the compression cylinder 10 is substantially less than the internal diameter of the expansion cylinder 26, but the stroke lengths are equal, permitting a substantially complete expansion in the expansion cylinder of the combustion gas to a larger volume than the compression cylinder volume. The volume of the heat exchanger first passageway 42 in combination with exposed portions of conduit 24 exceeds a single stroke discharge volume of the compression cylinder 10. Thus, a number of compression cylinder cycles of operation are required to fully charge the heat exchanger 40. Further, the volume of the heat exchanger first passageway 42 and conduit 24 exceeds the charge volume of expansion cylinder 26. The compressed air from compression cylinder 10 in the heat exchanger 40 is heated over a period of several cycles. The long time available for heating the charge permits the use of a small area heat exchanger.

A fuel injector 49 is disposed in the combustion chamber 32 for injecting fuel into the chamber. Combustion takes place in the expansion cylinder 26, either by injection of diesel fuel or spark ignition of the fuel-air mixture in the combustion chamber 32. If diesel fuel is used, the heat exchanger 40 heats the air in the first passageway to a temperature sufficient to achieve self-ignition of the fuel in the combustion chamber. The phasing of the two pistons 20, 34 in the two cylinders 10, 26 is such as to achieve nearly constant volume transfer of the compressed air.

The compression cylinder 10 is water cooled, as by water channels 50 in the compression cylinder walls 48, to maximize volumetric efficiency and minimize required compression work. Expansion cylinder walls 52 are thermally insulated, as by air gaps 54, and an expansion piston crown portion 56 is thermally insulated. The piston crown portion 56 includes an outer end plate 58 and an inner end plate 60 spaced from the outer end plate to define one or more air gaps 62 in the crown portion 56 between the outer and inner end plates 58, 60. The head portion 22 is provided with an air gap 66, or other insulative layer. Accordingly, the combustion gas delivers maximum expansion work and high thermal efficiency is exhibited by the engine.

Figure 2:
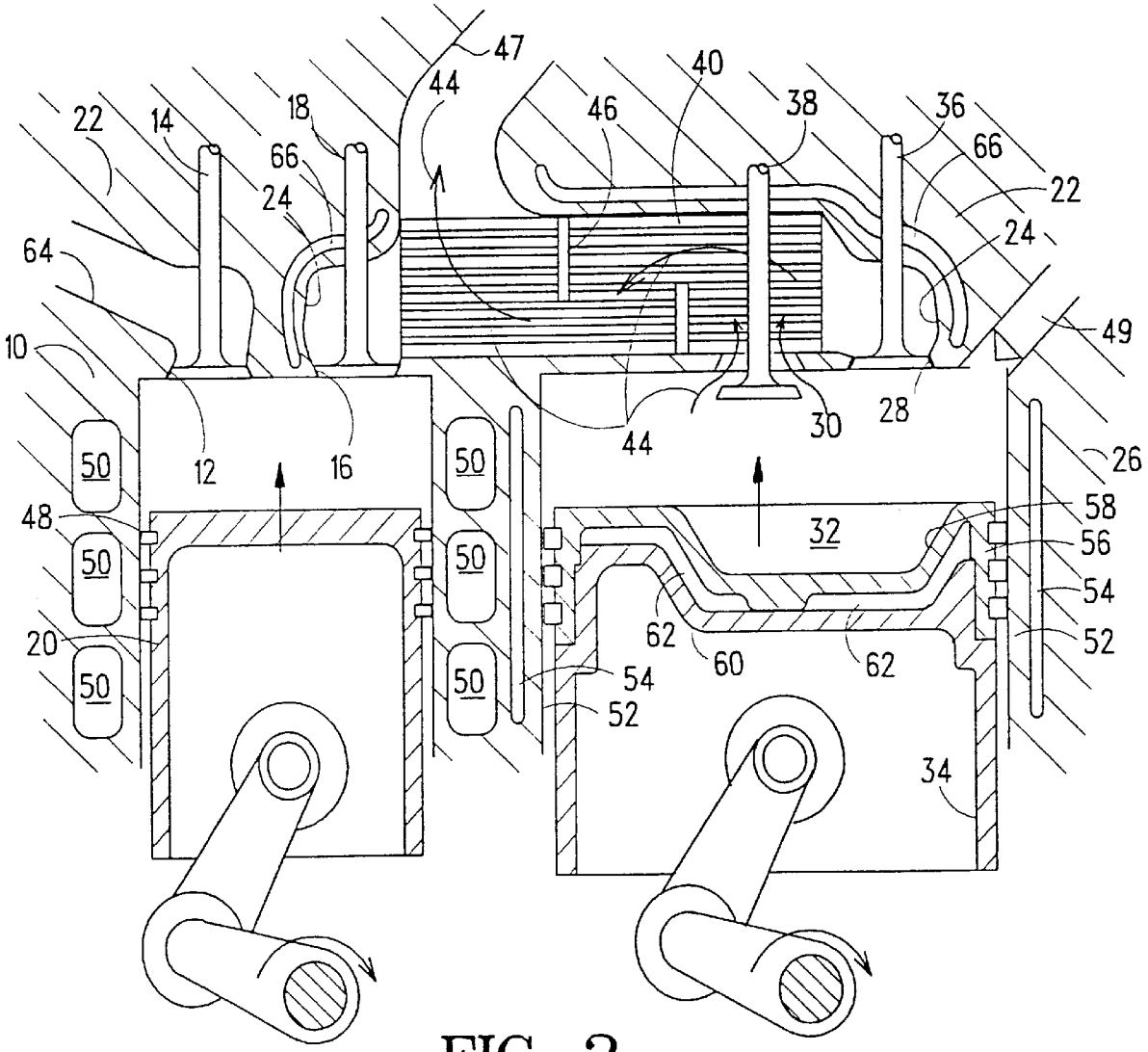
FIGS. 2–5 are similar to FIG. 1, but show operating components in different operative positions.
Figure 6:
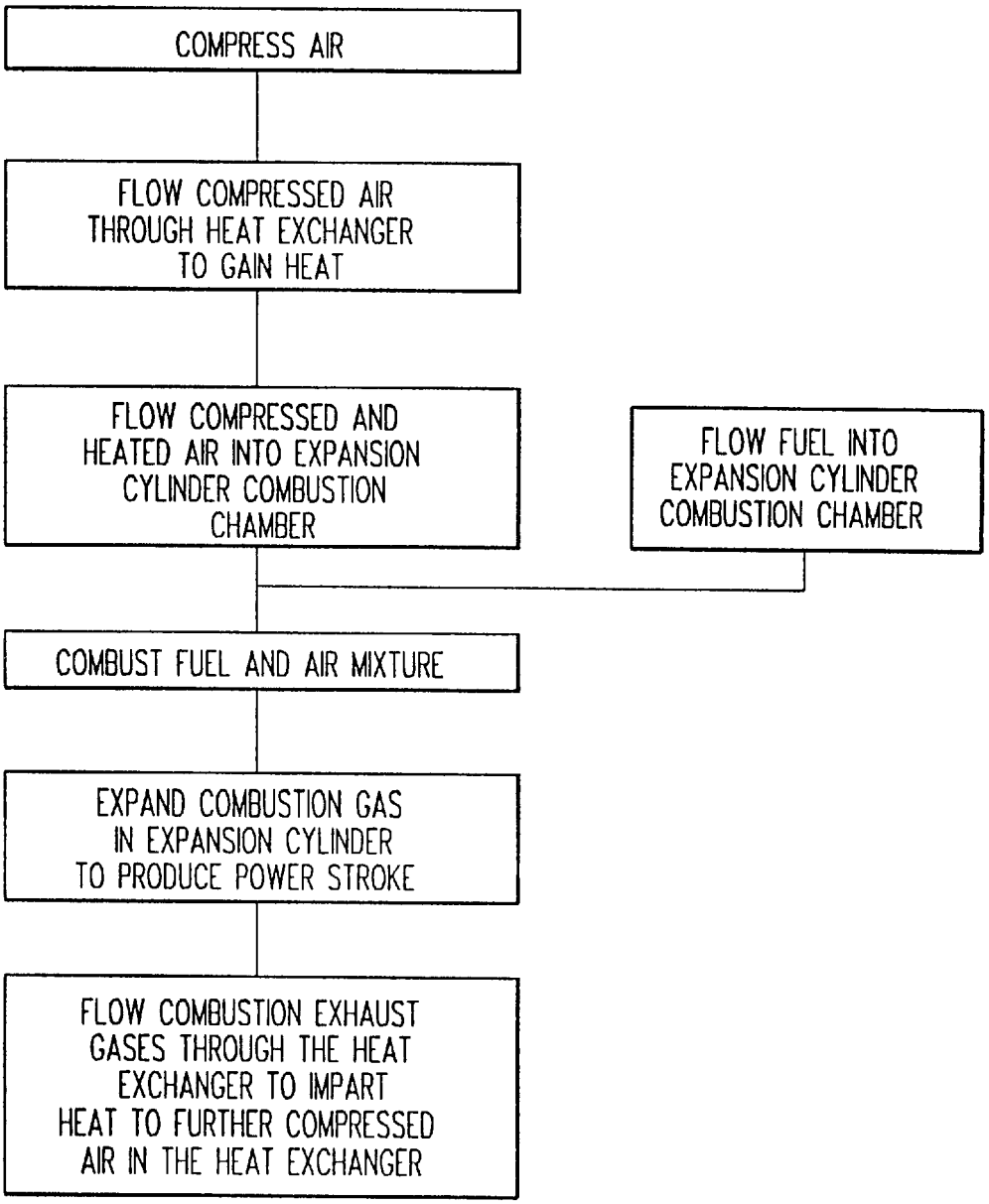
FIG. 6 is a block diagram illustrative of steps in a method for generating power.

Referring to FIG. 6, it will be seen that in operation of the above-described engine, and in practicing the inventive method, air is compressed (FIG. 2) in the compression cylinder 10. Substantially simultaneously therewith, exhaust gas from a previous cycle of operation is forced out of the expansion cylinder 26 and through the second passageway 44 in the heat exchanger 40.

Figure 3:
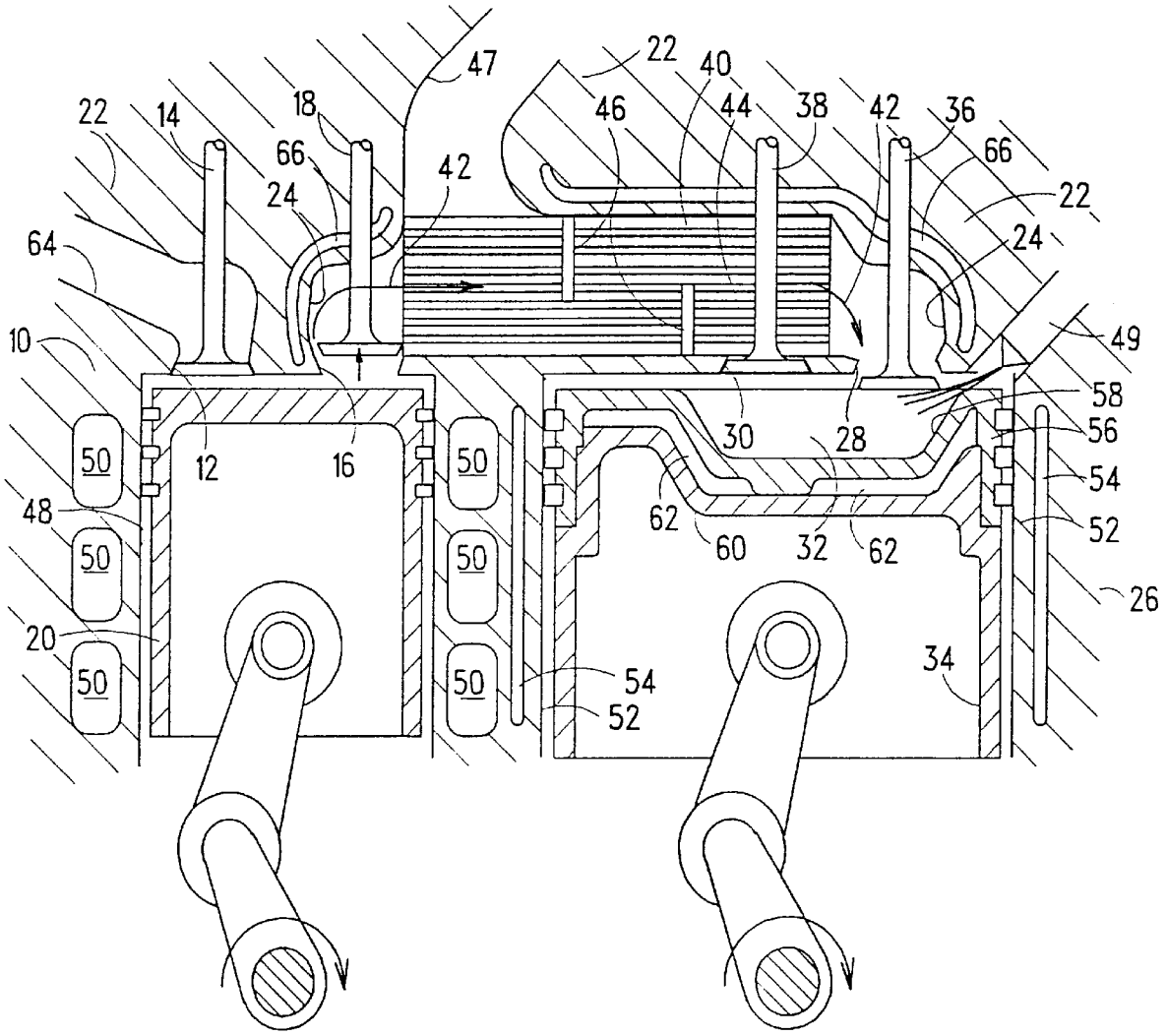

Upon opening of the air transfer outlet valve 18 and the air inlet valve 36 (FIG. 3), compressed air flows into the heat exchanger 40 to gain heat, and hot compressed air is flowed from the heat exchanger 40 into the expansion cylinder combustion chamber 32. At substantially the same time, fuel is flowed into the expansion cylinder combustion chamber 32 through fuel injector 49.

Figure 4:
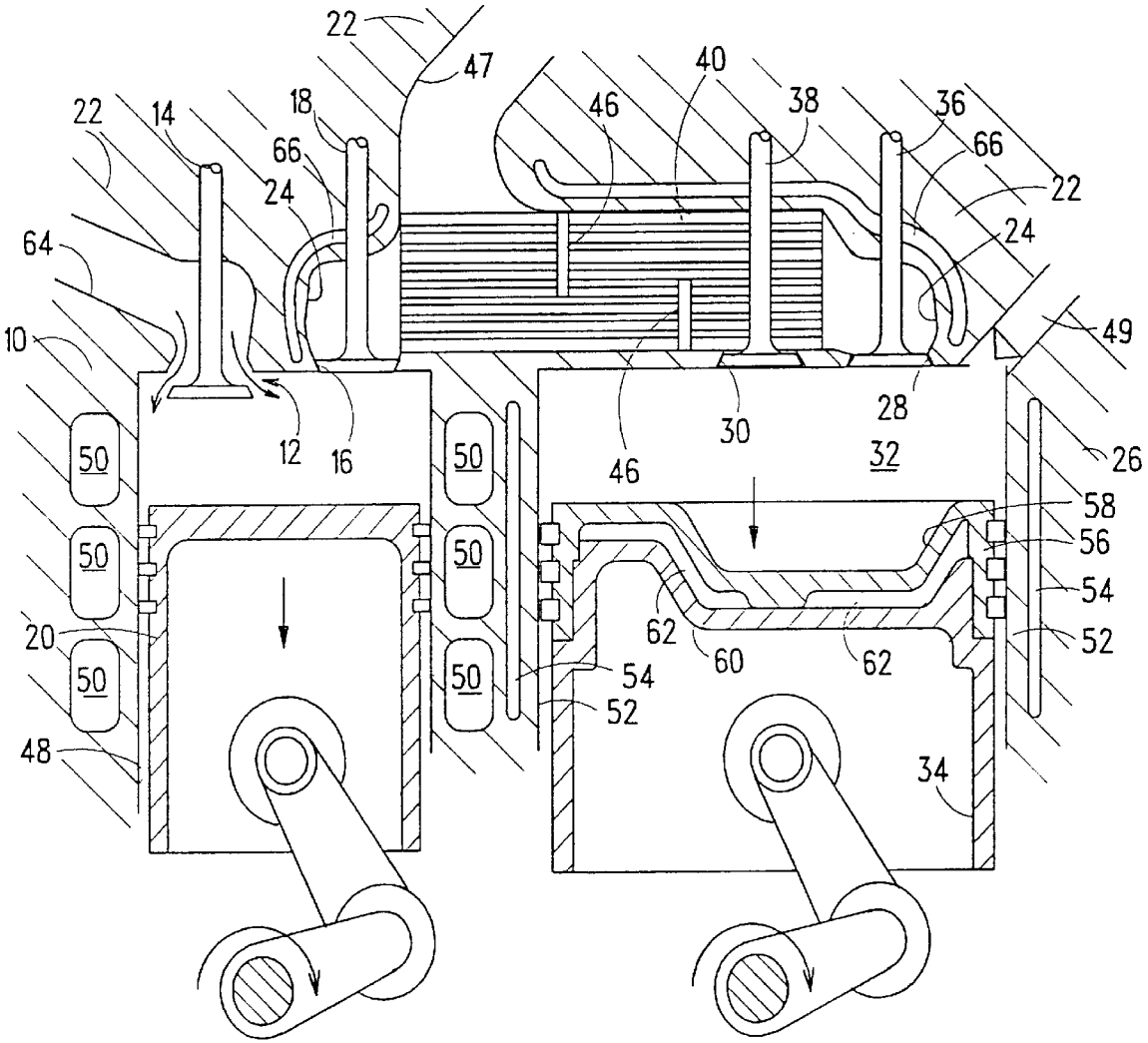

After closing of the valves 18 and 36, the fuel and air mixture in the combustion chamber 32 is combusted. The expansion of the combustion gases in the expansion cylinder 26 to a substantially larger volume than the compression cylinder 10 produces a power stroke (FIG. 4). At this time the inlet valve 14 opens and the compression cylinder 10 takes in a new charge of air from an inlet conduit 64 through the inlet 12.

The combustion exhaust gases are then flowed through the outlet 30 and the heat exchanger second passageway 44

Figure 5:
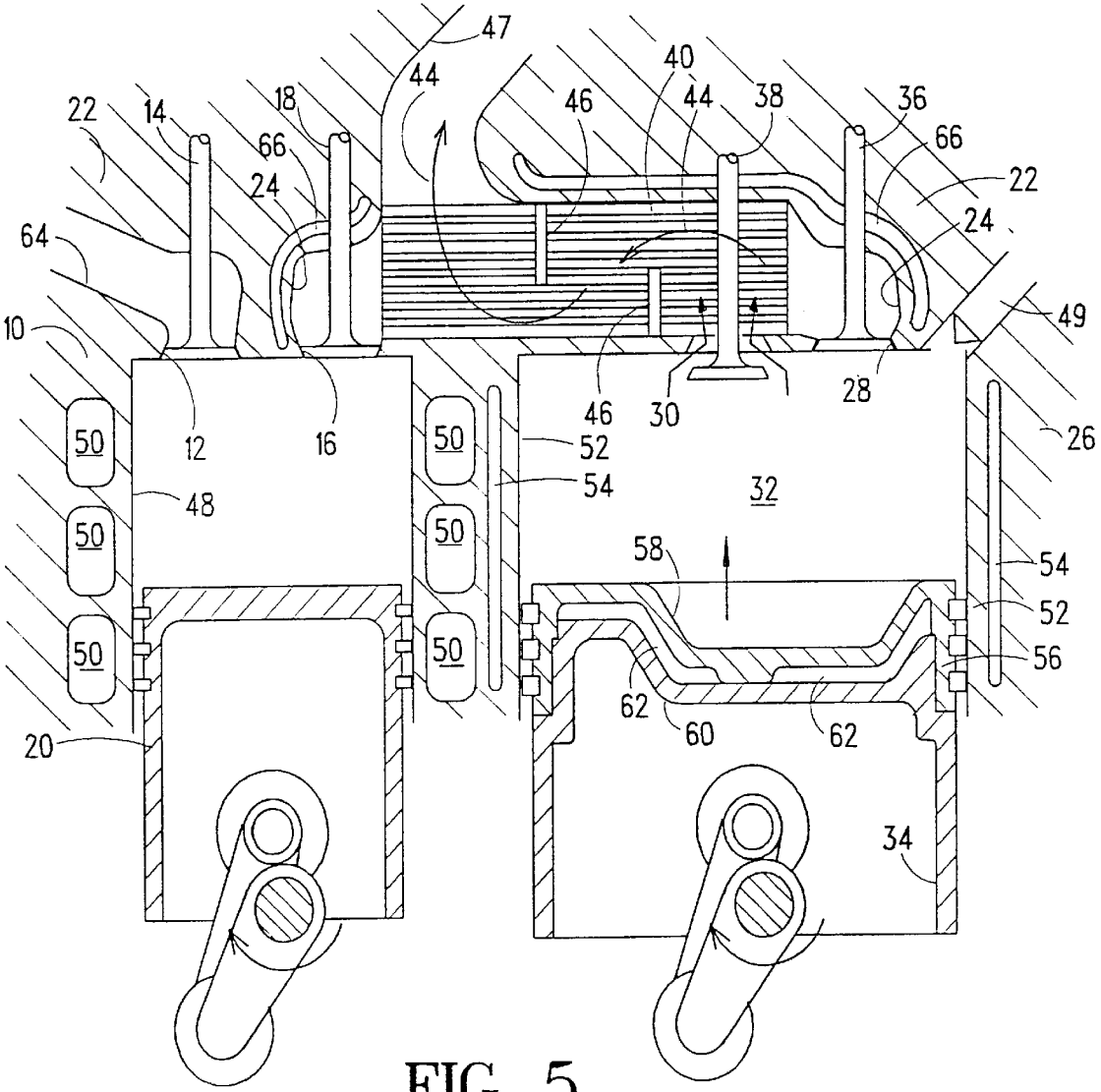

(FIG. 5): to impart heat to further compressed air in the heat exchanger 40, to repeat the cycle.

The system delivers one power stroke in every engine revolution, similar to two separate conventional cylinders, each delivering one power stroke every two revolutions. The engine can be turbocharged and/or provided with a turbocompound system for maximum efficiency. In such cases, the turbocharged air is fed to the compression cylinder through inlet conduit 64 and compression cylinder air inlet 12.

Because of the high thermal efficiencies exhibited by the engine described herein, the high expansion ratio, the low compression ratio, the low peak cylinder pressure, and the ability to autoignite diesel fuel, the construction is relatively light, and the overall weight of the engine is lower than a conventional diesel engine.

It is to be understood that the present invention is by no means limited to the particular construction herein disclosed and/or shown in the drawings, but also comprises any modifications or equivalents within the scope of the claims. For example, though the compression cylinder 10 and expansion cylinder 26 are shown side-by-side, such disposition is not necessary and it is contemplated that in some applications the cylinders will be disposed in a "V" configuration.

What is claimed is:

1. An internal combustion engine comprising:

a compression cylinder having an inlet and an outlet;

a conduit extending from said compression cylinder outlet;

an expansion cylinder having an inlet and an outlet, said inlet being in communication with said conduit;

a heat exchanger disposed in said conduit and having therein first and second passageways, said first passageway having a selected volume for flowing compressed air from said compression cylinder outlet to said expansion cylinder inlet;

said expansion cylinder outlet being in communication with said second passageway in said heat exchanger for flowing combustion exhaust gases from said expansion cylinder outlet through said heat exchanger;

whereby said heat exchanger operates to heat the compressed air before entry into said expansion cylinder and to cool the combustion exhaust gases before entry into an exhaust conduit in communication with said heat exchanger second passageway; and wherein the volume of said first passageway exceeds a single stroke discharge volume of said compression cylinder and exceeds a single intake volume of said expansion cylinder.

2. The engine in accordance with claim 1 wherein said expansion cylinder is provided with a diameter substantially exceeding a diameter of said compression cylinder.

3. The engine in accordance with claim 1 wherein baffle plates are positioned in said second passageway in said heat exchanger such that the exhaust gases from said expansion cylinder outlet are flowed a plurality of times cross-wise to said first passageway before exiting through said exhaust conduit.

4. The engine in accordance with claim 1 wherein said compression cylinder is water-cooled.

5. The engine in accordance with claims 4 wherein said expansion cylinder defines a combustion chamber and is thermally insulated.

6. The engine in accordance with claim 5 further comprising an expansion piston reciprocally disposed in said expansion cylinder, a crown portion of said expansion piston being thermally insulated.

7. The engine in accordance with claim 6 wherein said crown portion includes an outer end plate and an inner end plate spaced from said outer end plate to define an air gap in said crown portion between said outer and inner end plates.

8. An internal combustion engine comprising:

a compression cylinder having a first internal diameter, an inlet, an outlet, and a compression piston in said compression cylinder;

an expansion cylinder having a second internal diameter, and inlet, an outlet, and an expansion piston in said expansion cylinder; and a conduit extending from said compression cylinder outlet to said expansion cylinder inlet;

wherein said first diameter is substantially smaller than said second diameter; and wherein said conduit is provided with a volumetric capacity exceeding a single charge volume delivered by said compression cylinder and exceeding a single charge volume taken into said expansion cylinder.

9. The engine in accordance with claim 8 wherein said expansion cylinder includes a combustion chamber.

10. The engine in accordance with claim 9 further comprising a heat exchanger disposed in said conduit and having a first passageway therethrough for flowing compressed air from said compression cylinder outlet to said expansion cylinder inlet, and a second passageway therethrough for flowing combustion gases from said combustion chamber and said expansion cylinder outlet to an exhaust conduit, said first and second passageways being at least in part transverse to each other, such that heat transfer is exhibited therebetween.

11. A method for generating power, the method comprising the steps of:

compressing air in a compression cylinder;

flowing the compressed air through a heat exchanger first passageway to increase the temperature of the air;

flowing the compressed air from said heat exchanger into an expansion cylinder combustion chamber;

flowing fuel into said combustion chamber to provide a fuel and air mixture in said combustion chamber;

combusting the fuel and air mixture in said combustion chamber;

expanding combusted gas in said expansion cylinder to a volume substantially larger than the volume of said compression cylinder to produce a power stroke; and flowing combustion exhaust gases from said expansion cylinder and through a second passageway of said heat exchanger to impart heat to further compressed air in said first passageway of said heat exchanger;

wherein the step of flowing compressed air through said heat exchanger includes flowing a charge of compressed air from the compression cylinder into said heat exchanger, the charge being of substantially less volume than the volumetric capacity of said heat exchanger.

12. The method in accordance with claim 11 wherein the step of flowing compressed air from said heat exchanger into the expansion cylinder combustion chamber includes flowing a charge of compressed and heated air from said heat exchanger into said combustion chamber, said compressed and heated air charge being of a volume less than said volumetric capacity of said heat exchanger.

13. A method for generating power, the method comprising the steps of:

providing a compression cylinder having an inlet and an outlet;

providing an expansion cylinder having an inlet and an outlet;

providing a conduit extending from said compression cylinder outlet to said expansion cylinder inlet;

providing a heat exchanger disposed in said conduit and having a first passageway for flowing compressed air from said compression cylinder to said expansion cylinder;

said expansion cylinder outlet being in communication with a second passageway in said heat exchanger for flowing exhaust gases from said expansion cylinder through said heat exchanger;

flowing air through said compression cylinder inlet into said compression cylinder;

compressing the air in said compression cylinder;

flowing the compressed air from said compression cylinder through said first passageway of said heat exchanger and through said expansion cylinder inlet into said expansion cylinder;

admitting fuel to said expansion cylinder to provide a fuel and air mixture;

combusting the fuel and air mixture in said expansion cylinder;

expanding combustion gas in said expansion cylinder to a substantially larger volume than a compression cylinder volume to produce a power stroke; and flowing combustion exhaust gases from said expansion cylinder and through said second passageway in said heat exchanger to transfer heat therefrom to further compressed air in said first passageway;

wherein the step of flowing compressed air through said heat exchanger includes flowing a charge of compressed air from said compression cylinder into said heat exchanger, said charge being of substantially less volume than the volumetric capacity of said heat exchanger; and wherein the step of flowing compressed air from said heat exchanger into said expansion cylinder includes flowing a charge of compressed and heated air from said heat exchanger into said expansion cylinder, said compressed and heated air charge being of a volume less than a volumetric capacity of said heat exchanger.

14. The method in accordance with claim 13 wherein an expansion piston is reciprocally disposed in said expansion cylinder and said combustion of the fuel and air mixture in the expansion cylinder drives said expansion piston to provide said power stroke, and wherein one power stroke is effected from each engine revolution.

15. The method in accordance with claim 13 wherein said expansion cylinder is provided with a combustion chamber and the step of admitting fuel to said expansion cylinder comprises admitting diesel fuel to said combustion chamber, the method including the step of heating the compressed air in the heat exchanger to ignition temperature.

16. The method in accordance with claim 13 wherein said expansion cylinder is provided with a combustion chamber and the step of admitting fuel to said expansion cylinder comprises admitting gasoline to said combustion chamber, the method including the step of actuating an ignition spark device in said combustion chamber to combust said fuel and air mixture.

* * * * *